US008720418B2

(12) United States Patent
Bonneau et al.

(10) Patent No.: US 8,720,418 B2
(45) Date of Patent: May 13, 2014

(54) FUEL INJECTION SYSTEM

(75) Inventors: David Bonneau, Blois (FR); Guillaume Trenado, Les Montils (FR)

(73) Assignee: Delphi International Operations Luxembourg, S.A.R.L., Luxembourg (LU)

( * ) Notice: Subject to any disclaimer, the term of this patent is extended or adjusted under 35 U.S.C. 154(b) by 491 days.

(21) Appl. No.: 13/133,570

(22) PCT Filed: Dec. 17, 2009

(86) PCT No.: PCT/EP2009/067439
§ 371 (c)(1),
(2), (4) Date: Jun. 8, 2011

(87) PCT Pub. No.: WO2010/072651
PCT Pub. Date: Jul. 1, 2010

(65) Prior Publication Data

US 2011/0239990 A1 Oct. 6, 2011

(30) Foreign Application Priority Data

Dec. 23, 2008 (EP) ..... 08172800

(51) Int. Cl.
*F02M 69/46* (2006.01)

(52) U.S. Cl.
USPC ..... 123/456; 123/468

(58) Field of Classification Search
USPC ..... 123/452, 456, 468
See application file for complete search history.

(56) References Cited

U.S. PATENT DOCUMENTS

| | | | | |
|---|---|---|---|---|
| 3,602,256 | A * | 8/1971 | Olszewski et al. | 137/565.33 |
| 6,213,095 | B1 | 4/2001 | Asada et al. | |
| 6,497,219 | B2 * | 12/2002 | Natsume | 123/468 |
| 6,637,407 | B1 | 10/2003 | Boecking | |
| 7,516,734 | B2 * | 4/2009 | Tominaga et al. | 123/456 |
| 2002/0112697 | A1 * | 8/2002 | Knoedl et al. | 123/456 |
| 2004/0003795 | A1 * | 1/2004 | Kondo | 123/447 |
| 2004/0226540 | A1 * | 11/2004 | Kreschel et al. | 123/456 |
| 2010/0108036 | A1 * | 5/2010 | Kutsukake et al. | 123/456 |

FOREIGN PATENT DOCUMENTS

| | | |
|---|---|---|
| CN | 1193690 A | 9/1998 |
| DE | 199 45 316 | 4/2001 |
| DE | 101 23 234 | 11/2002 |
| JP | 2003-511605 | 3/2003 |
| JP | 2004-239212 | 8/2004 |
| WO | 2008041374 | 4/2008 |

OTHER PUBLICATIONS

International Search Report dated Aug. 24, 2010.
China Office Action and Comments regarding Office Action dated Dec. 24, 2012.
Comments regarding Japan Office Action dated Jan. 16, 2013.

* cited by examiner

*Primary Examiner* — Willis R Wolfe, Jr.
*Assistant Examiner* — Anthony L Bacon
(74) *Attorney, Agent, or Firm* — Lawrence D. Hazelton

(57) ABSTRACT

The invention relates to a fuel injection system of the common rail type having a rail body comprising a central bore and one or more outlet bores in fluid communication with the central bore for communicating with a respective fuel injector. The outer circumference of the rail body is substantially oval in cross-section and is thicker in cross-section in a direction substantially perpendicular to the outlet bore axis as compared to the thickness in cross-section substantially parallel to the outlet bore axis. By increasing the thickness of the rail body in this way, stresses at the intersection of the intersection of the central bore with the outlet holes may be reduced by up to 10% or more, thereby increasing the acceptable cycled running pressure of the system.

6 Claims, 4 Drawing Sheets

Mean table

FUEL INJECTION SYSTEM

CROSS REFERENCE TO RELATED APPLICATION

This application claims the benefit under 35 U.S.C. §371 of published PCT Patent Publication Number PCT/EP 2009/067439, filed Dec. 17, 2009, the entire disclosure of which is hereby incorporated herein by reference.

TECHNICAL FIELD

The present invention relates to a fuel supply system for use in supplying fuel under high pressure to the combustion spaces of an internal combustion engine. In particular, the invention relates to a fuel injection system of the common rail type.

BACKGROUND TO THE INVENTION

A common rail fuel system typically comprises a common rail body in the form of a high pressure pipe which is charged to a high pressure by an appropriate high pressure fuel pump. A plurality of connection lines are connected to the common rail body via branch holes or outlets in the pipe, each connection line leading to a respective fuel injector. The central bore of the pipe therefore acts as a pressure accumulation chamber from which pressurised fuel is distributed towards the injectors.

It will be understood that during each fuel delivery cycle the common rail is subject to significant stresses caused by the high fuel pressure. In particular, the inner pressure of the rail causes high tensile stress at the peripheral edges of the openings where the bore of the pipe meets the branch holes. Over a period of time, such stress is liable to cause cracks in the vicinity of the openings and hence may give rise to fuel leakage.

Accordingly, efforts have focussed on improving the resistance of the common rail to stress fatigue. By increasing the strength of the common rail, it becomes possible to increase the acceptable cycled running pressure of the fuel supply system.

In the majority of known fuel supply systems, the common rail body is typically of circular cross-section. The simplest way to improve durability of such a rail is to increase the diameter of the body. Although this is readily achievable, any benefit in terms of enhanced durability is largely offset by the attendant material cost resulting from an increase in the quantity of steel required to produce a thicker rail.

Another approach to improving fatigue strength, as described in JP 10169527, is to use a pipe of elliptical cross-section for the common rail. Such an elliptical pipe is shaped by plastically deforming a round pipe, for example by press working or roll forming. However, the deformation process itself induces residual stresses in the common rail body. So, stresses always remain at the intersecting portion where the branch opening meets the pressure accumulation bore. Even if the tensile stresses at the intersecting portion induced by the inner pressure of highly pressurised fuel in the pressure accumulation chamber is reduced, the sum of the residual stresses and the stresses due to inner pressure is likely to be large enough still to compromise strength at the intersecting portion.

In the above arrangement, by virtue of the manufacturing process, both the pipe and the pressure accumulation chamber created by the central bore are elliptical in cross-section and pipe thickness remains substantially uniform throughout. By contrast, in US-A1-2001/0029929 a common rail pipe having a substantially circular outer cross-section and internal bore of roughly oval or flat oval cross-section is described.

Although the creation of the internal bore does not in this case involve deformation of a round pipe and hence avoids residual stresses, a two stage manufacturing process is required; the first stage involving drilling to form a round bore and in the second stage the opposite sides of an inner wall of the round bore are removed by broaching or by electric discharge machining to create the oval cross-section.

It will be appreciated therefore that the common rail bodies made according to the prior art suffer from disadvantages. Accordingly, it is an object of the present invention to provide a fuel injection system having a common rail body of improved durability that may be readily manufactured.

SUMMARY OF THE INVENTION

Against this background, the invention resides in a fuel injection system comprising a common rail body having a central bore and one or more outlet bores in fluid communication with the central bore for communicating with a respective fuel injector, wherein the outer circumference of the body is substantially oval in cross-section and the body wall is thicker in cross-section in a direction substantially perpendicular to the outlet bore axis as compared to the thickness in cross-section substantially parallel to the outlet bore axis.

Surprisingly, the Applicant has found that by increasing the thickness of the rail body wall in a direction substantially perpendicular to the outlet bore axis without necessarily increasing the thickness of the body wall in a direction substantially parallel to the outlet bore can reduce the stresses at the intersection of the drilling holes (that is, the intersection of the central bore with the outlet holes) by up to 10%, or more. Hence, by means of the invention, it is possible not only to improve the fatigue strength of the rail body over a conventional circular cross-section body but also avoid the residual stresses created by deformation of a pipe body of circular cross-section. Moreover, as there are no significant improvements in fatigue strength by increasing the thickness of the rail body in a direction substantially parallel to the outlet bore, additional material costs may be kept to a minimum.

From another aspect, the present invention resides in a rail body for a common rail fuel supply system, the body comprising a central bore and one or more outlet bores in fluid communication with the central bore for communicating with a respective fuel injector, wherein the outer circumference of the rail body is substantially oval in cross-section and the body wall is thicker in cross-section in a direction substantially perpendicular to the outlet bore axis as compared to the wall thickness in cross-section substantially parallel to the outlet bore axis.

As will be understood, where a rail body includes a plurality of outlet bores for communicating with a respective fuel injector, each outlet bore will be substantially parallel with the other such bores so that "a direction parallel to the outlet bore" will be the same for each bore. In common with known rail bodies, the outlet bores typically intersect with the central bore substantially perpendicularly to each other.

Preferably the central bore is substantially circular in cross-section. In this way, the central bore through the rail body can be formed, for example, by gun drilling without any additional profiling steps.

The outer circumference of the rail body may, for example, comprise a regular oval shape, such as elliptical, or a flat oval where the outer circumference around the minor axis of the oval is substantially linear.

Advantageously, the thickness of the rail body wall in a direction substantially perpendicular to the outlet bore ranges from 1.2 to 1.9 times the thickness of the rail body wall in a direction substantially parallel to the outlet bore. More preferably, the thickness ranges from 1.3 to 1.8 times.

Known rail bodies may typically have a uniform wall thickness of about 8.5 mm. Thus in a preferred aspect of the present invention, the thickness of the rail body wall in a direction substantially parallel to the outlet bore is maintained at about 8.5 mm whereas the wall thickness in the direction substantially perpendicular to the outlet bore is increased to a range of from about 10.2 mm to 16.2 mm, more preferably from about 11.75 to 15 mm.

Alternatively, another preferred rail body is one where the thickness of the rail body wall in a direction substantially parallel to the outlet bore is about 11.75 mm and the wall thickness in the direction substantially perpendicular to the outlet bore is increased to about 15 mm.

BRIEF DESCRIPTION OF THE DRAWINGS

The invention will now be described, by way of example only, also with reference to the following drawings, in which:

As shown in FIG. 1, a common rail system typically includes a tubular common rail body 2 having four outlet bores 4*a*, 4*b*, 4*c*, 4*d* (not visible) each connected via high pressure pipes 16*a*, 16*b*, 16*c*, 16*d* to fuel injectors 6*a*, 6*b*, 6*c*, 6*d*. Fuel enters the system via fuel filter 8 which removes particulate contaminants before passing to high pressure pump 10 from where fuel is pressurised and charged to the common rail body 2 via supply pipe 12. Electronic control unit (ECU) 14 is calibrated with the injectors 6*a*, 6*b*, 6*c*, 6*d* to provide the desired injection characteristics for the vehicle engine.

FIG. 2*a* is a perspective view of a typical common rail body 2, such as would be used in the system of FIG. 1. The body 2 is tubular, substantially circular in cross-section, with a correspondingly circular central bore 22. Four outlet bores 4*a*, 4*b*, 4*c*, 4*d* communicating with the central bore 22 are aligned along the body 2 for connection with fuel injectors via respective pressure pipes (not shown).

The central bore 22 is most commonly created from a solid casting by gun drilling. Similarly, the outlet bores 4*a*, 4*b*, 4*c*, 4*d* are also generally created using drilling methods. Studies of common rail bodies show that stress occurs particularly at the intersections between drilling holes, that is the intersections between the central bore 22 and each outlet bore 4*a*, 4*b*, 4*c*, 4*d*. FIG. 2*b* which is a cross-section along line A-A of FIG. 2*a* illustrates high stress region 32 at the intersection 30 of central bore 22 and outlet bore 4*c*.

FIG. 3*a* shows a perspective view of a rail body 42 having an outer circumference of oval cross-section in accordance with an aspect of the invention and FIG. 3*b* illustrates a cross-section through the body 42. Like the rail body 2 of FIGS. 2*a* and 2*b*, the body 42 still has a central bore 22 of circular cross-section and a plurality of substantially parallel outlet bores of which only outlet bore 4*c* is shown. The wall thickness "A" of the body 42 around the central bore 22 in a direction substantially perpendicular to the axis of outlet bore 4*c* and the wall thickness "B" in a direction substantially parallel to the axis of the outlet bore 4*c* is varied in accordance with the dimensions shown in Table 1 below.

TABLE 1

| A (mm) | B (mm) | σ (1400 bars) |
|---|---|---|
| 15 | 8.5 | 441,538 |
| 15 | 11.75 | 440,975 |
| 15 | 15 | 443,772 |
| 11.75 | 8.5 | 460,610 |
| 11.75 | 11.75 | 464,687 |
| 11.75 | 15 | 463,626 |
| 8.5 | 8.5 | 499,129 |
| 8.5 | 11.75 | 500,684 |
| 8.5 | 15 | 499,129 |

Figure 1:
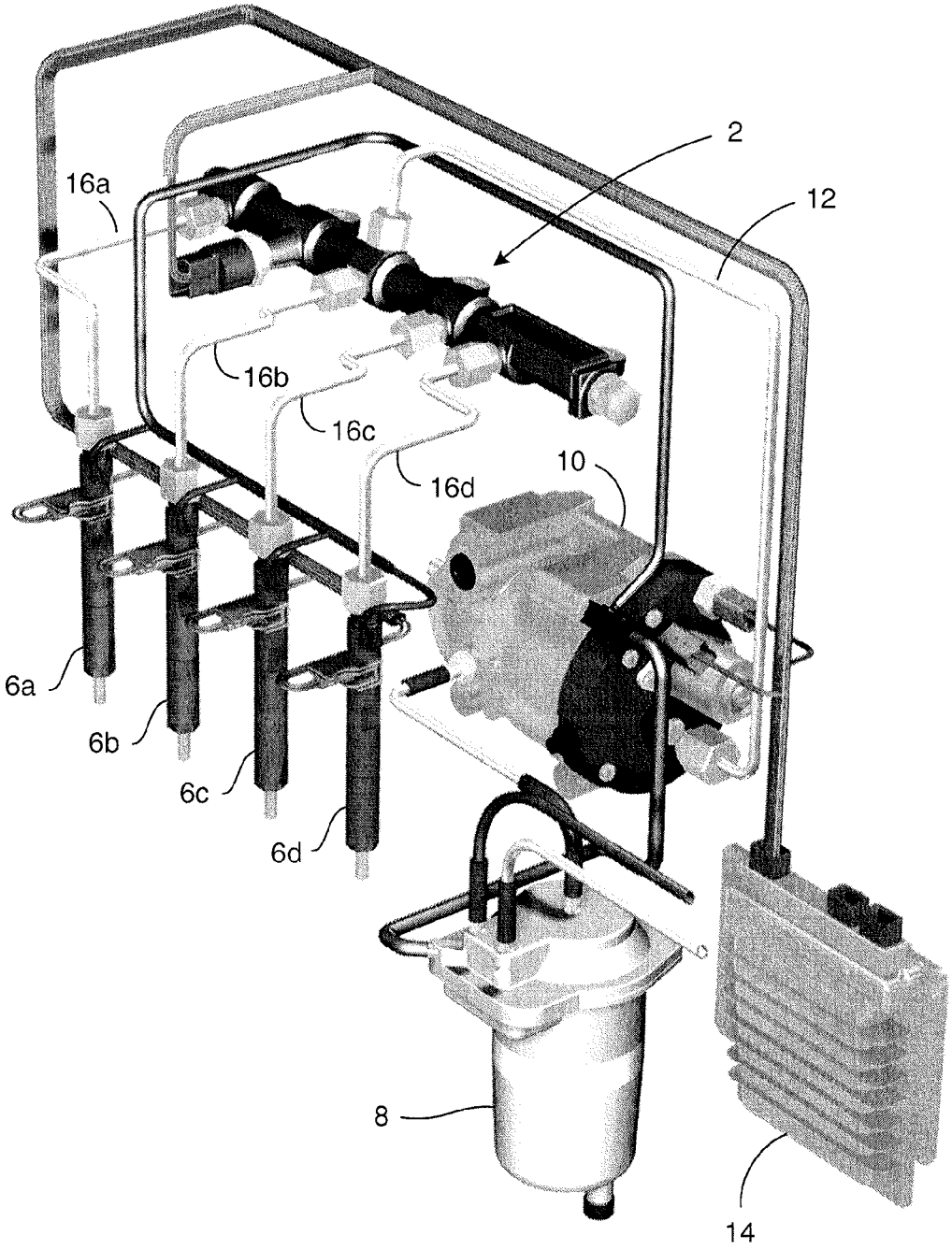
FIG. 1 shows a common rail system according to the prior art.
Figure 2A:
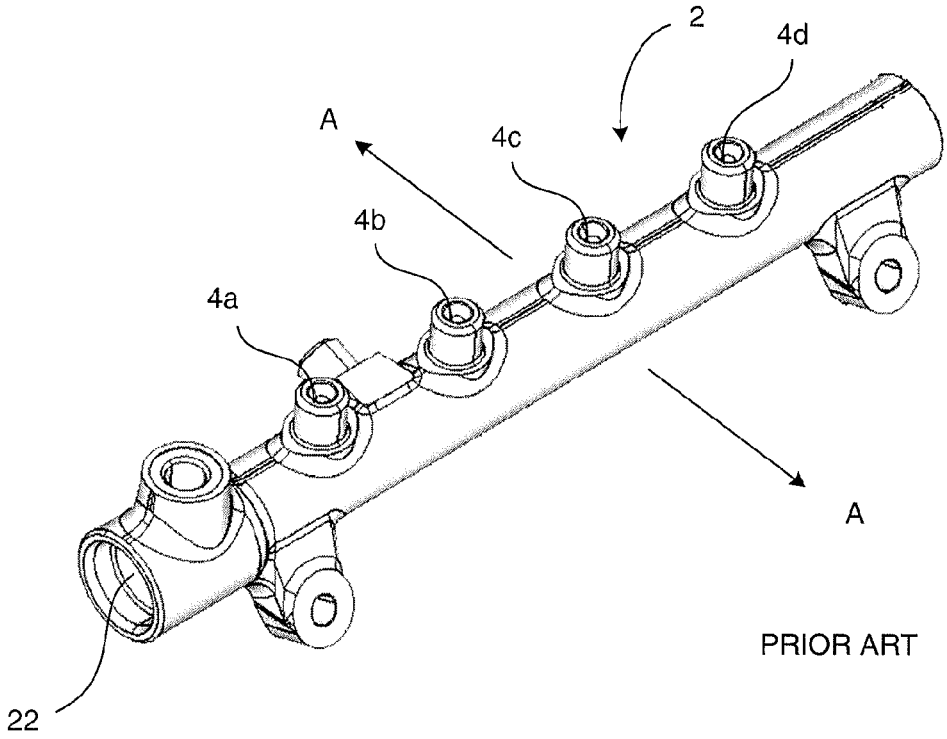
FIG. 2*a* is a perspective view of a prior art rail body and FIG. 2*b* is a cross-section through line A-A of FIG. 2*a;*
Figure 2B:
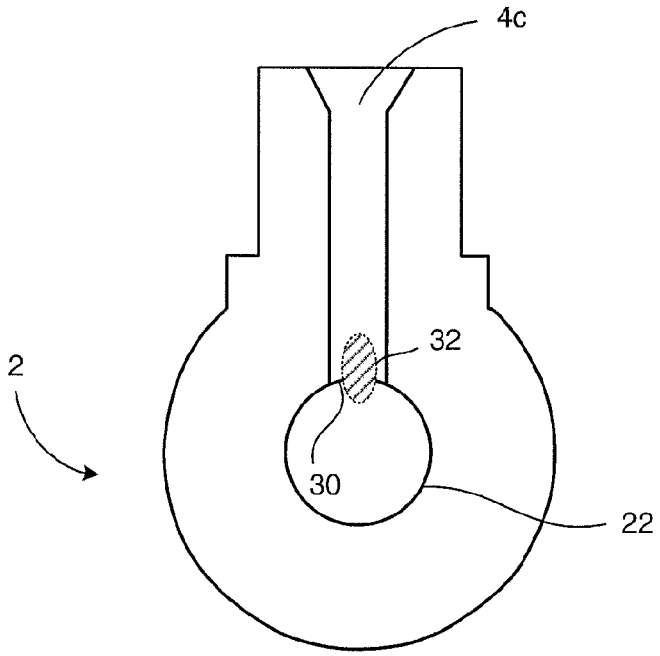
Figure 3A:
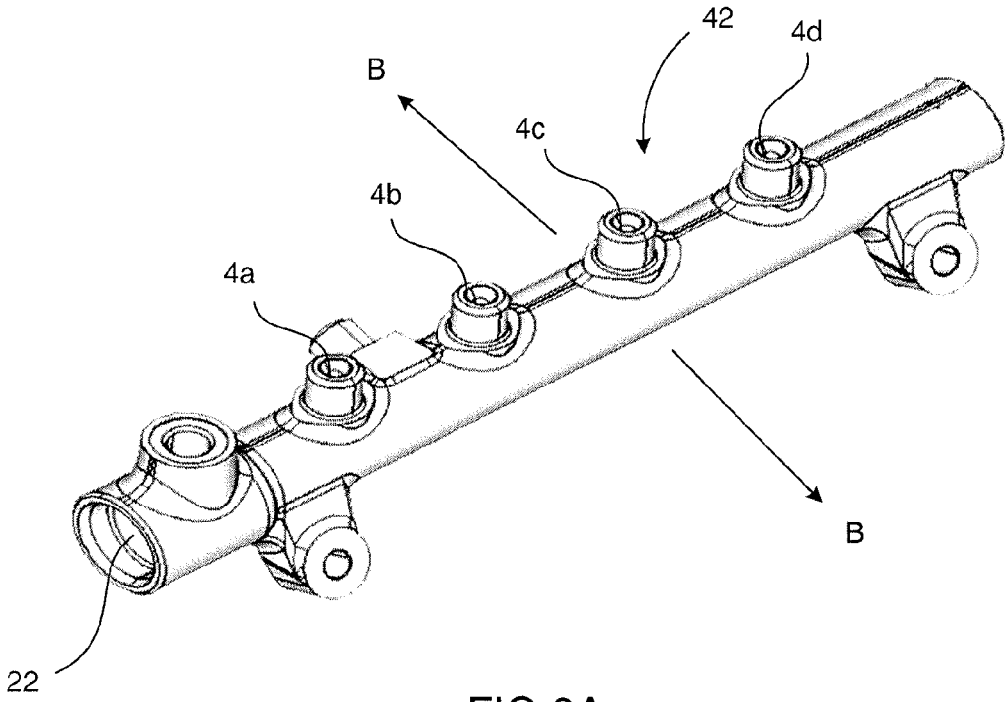
FIG. 3*a* is a perspective view of a rail body in accordance with a first aspect of the invention and FIG. 3*b* is a cross-section through line B-B of FIG. 3*a*.
Figure 3B:
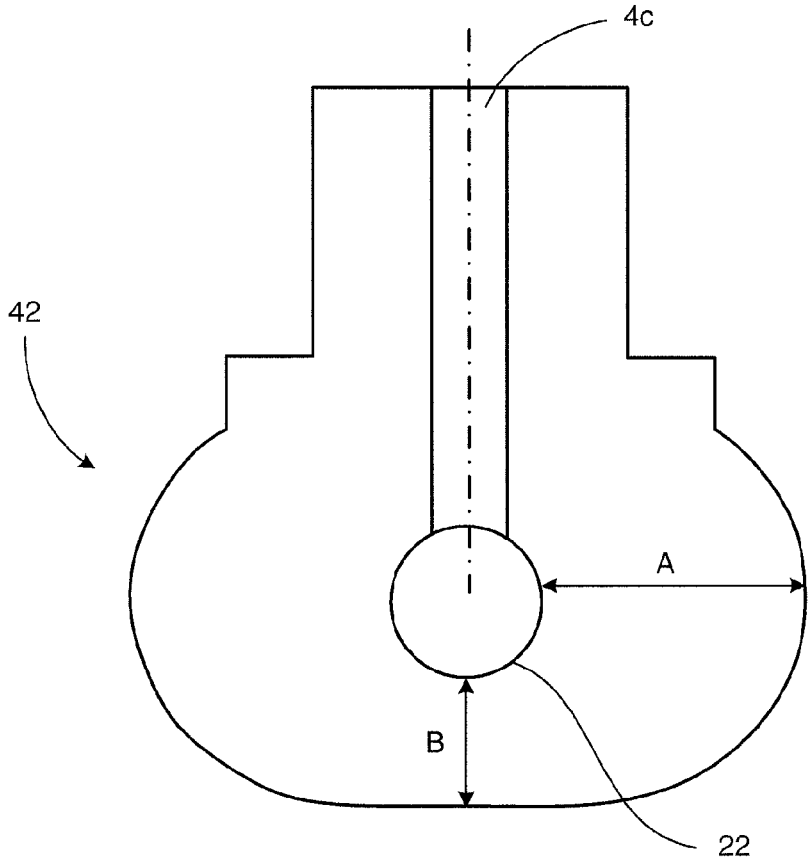
Figure 4:
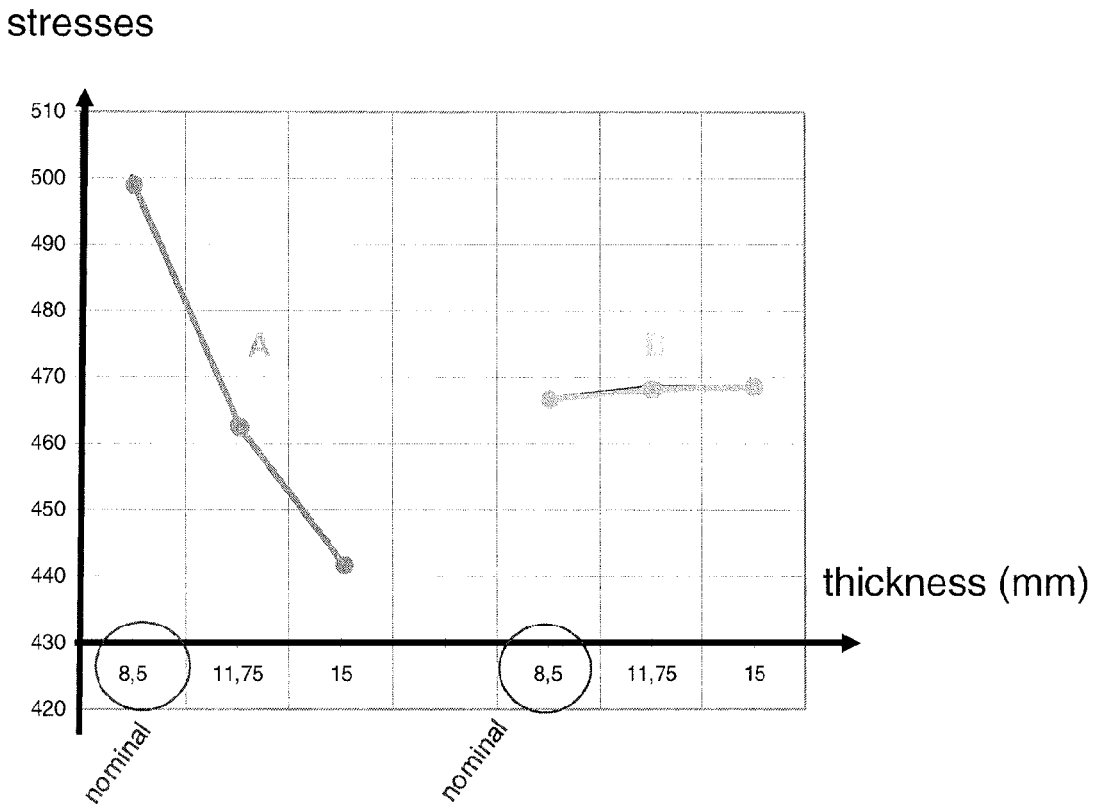
FIG. 4 illustrates the effect on stress of varying rail body thickness.

FIG. 4 illustrates the effect on stress of varying the thickness parameters, A and B, based on a nominal wall thickness of 8.5 mm. As will be seen, increasing thickness B (parallel to outlet bore) from 8.5 mm to 15 mm has little effect on stress at the intersection, whereas increasing thickness A (perpendicular to outlet bore) from 8.5 mm to 15 mm enables a reduction in stress of about 12%. Moreover, whilst increasing both thickness A and thickness B equally (thereby keeping a generally circular cross-section as opposed to an oval shape) does improve stress resistance as might be expected, the improvement is not so pronounced as when A>B.

It will be appreciated that various modifications may be made to the above described embodiment without departing from the scope of the invention, as defined by the claims. For example, the central bore of the rail body may also be oval in cross-section, albeit with the body wall being maintained relatively thicker in a direction perpendicular to the outlet bore axis as compared to the wall thickness in a direction parallel to the outlet bore axis.

The invention claimed is:

1. A common rail fuel injection system having a common rail body comprising a central bore and one or more outlet bores in fluid communication with the central bore for communicating with a respective fuel injector, wherein the outer circumference of the rail body is characterized as a flat oval in cross-section and the body wall is thicker in cross-section in a direction substantially perpendicular to the outlet bore axis as compared to the wall thickness in cross-section substantially parallel to the outlet bore axis, wherein the central bore is substantially circular in cross-section, and wherein the outer circumference around the minor axis of the flat oval is substantially linear.

2. A system according to claim 1, wherein the wall thickness of the rail body in a direction substantially perpendicular to the outlet bore ranges from 1.2 to 1.9 times the wall thickness of the rail body in a direction substantially parallel to the outlet bore.

3. A system according to claim 2, wherein the wall thickness of the rail body in a direction substantially perpendicular to the outlet bore ranges from 1.3 to 1.8 times the wall thickness of the rail body in a direction substantially parallel to the outlet bore.

4. A system according to claim 3, wherein the wall thickness of the rail body in a direction substantially perpendicular to the outlet bore is about 1.3 times the wall thickness of the rail body in a direction substantially parallel to the outlet bore.

5. A system according to claim 3, wherein the wall thickness of the rail body in a direction substantially perpendicular to the outlet bore is about 1.8 times the wall thickness of the rail body in a direction substantially parallel to the outlet bore.

6. A rail body according to claim 1, wherein the central bore is formed by gun-drilling.

* * * * *